United States Patent [19]

Sanders et al.

[11] 3,961,945

[45] June 8, 1976

[54] ALUMINUM-SILICON COMPOSITE

[75] Inventors: Robert N. Sanders, Baton Rouge, La.; Alex R. Valdo, Phoenix, Ariz.

[73] Assignee: Ethyl Corporation, Richmond, Va.

[22] Filed: Apr. 19, 1974

[21] Appl. No.: 462,312

Related U.S. Application Data

[63] Continuation-in-part of Ser. No. 219,523, Jan. 20, 1972, abandoned.

[52] U.S. Cl. ..... 75/142; 29/191.2; 75/141

[51] Int. Cl.[2] ..... C22C 21/02

[58] Field of Search ..... 75/148, 138, 141, 142; 148/32, 32.5; 29/191.2

[56] References Cited

UNITED STATES PATENTS

| | | | |
|---|---|---|---|
| 2,793,949 | 5/1957 | Imich | 75/138 |
| 3,600,163 | 8/1971 | Badia et al. | 75/138 |

*Primary Examiner*—R. Dean

*Attorney, Agent, or Firm*—Donald L. Johnson; John F. Sieberth; Paul H. Leonard

[57] ABSTRACT

An aluminum-silicon composite comprising aluminum and silicon as the principal metals with lesser amounts of iron, titanium, magnesium and zinc and a substantial amount of a non-metal filler such as zircon, alumina, zirconia or aluminum silicates.

4 Claims, No Drawings

ALUMINUM-SILICON COMPOSITE

CROSS-REFERENCE TO RELATED APPLICATION

This application is a continuation-in-part of application Ser.No. 219.523, filed on Jan. 20, 1972 and subsequently abandoned.

BACKGROUND OF THE INVENTION

The present invention is in the general field of metallurgy and relates particularly to non-ferrous metallurgy. The invention is especially related to aluminum-silicon alloys.

It has been previously discovered, U.S. Pat. No. 2,793,949, that inorganic substances may be incorporated in metals to produce a composite material product. It is taught therein that mixtures of molten metals, including aluminum, and a large variety of inert fillers, including alumina, may be smelted together if the non-metallic material to be incorporated into the metal is wetted by the molten metal used. The wetting agents chosen are those among substances which are capable of lowering the surface tension between the metals and the materials to be incorporated therein. Such prior art also teaches that to modify the structural properties of a metal only slight amounts, less than 1 percent, say 0.1 percent, of powders or crystal materials should be added to the metal. On the other hand, when the object is to obtain, for example, abrasive compositions, the ratio of hard materials to be mixed with the molten metal should preferably exceed 50 percent by volume of the composite product and may be as high as 95 percent. Although a wide variety of metals and fillers are disclosed, no commercial success has apparently been achieved with the use of any compositions prepared by such process. Also, a number of the compositions disclosed in the reference are highly dangerous, being in fact explosive compositions.

More recently, it has been discovered that a superior aluminum composite can be prepared from aluminum, an alkaline earth metal reducing agent, such as magnesium, calcium, beryllium, sodium, potassium, rubidium or cesium, and a non-metal filler such as zircon, alumina, zirconia and aluminum silicates. See U.S. Pat. application Ser. No. 210,127 filed Dec. 20, 1971, having a common assignee with the instant invention, now abandoned.

It is therefore a primary object of the present invention to provide a new and improved aluminum-silicon alloy and composite which has sufficient strength to perform the required or desired use thereof and which is considerably less expensive than presently available aluminum-silicon alloys, especially aluminum-silicon casting alloys.

The instant invention is particularly adapted for use in the manufacture of articles wherein hardness is a principal requirement. An example of such articles are automobile engines or other engines and certain small engine parts.

It is also a primary object of the present invention to provide an aluminum-silicon alloy and composite thereof which exhibits improved properties such as tensile strength, hardness and toughness.

An important object of the present invention is to provide an aluminum-silicon composite which may be remelted and cast without any significant loss of its physical or structural properties.

Another object of the present invention is to provide a method for manufacturing an aluminum-silicon composite of material in which the physical properties may be varied over a wide range as desired, by appropriate changes in the composition.

Still another object of the present invention is to provide a new and useful aluminum-silicon composite which is substantially uniform in construction.

Other objects and advantages of the invention will become more readily apparent from a reading of the specification hereinafter.

SUMMARY OF THE INVENTION

The invention relates to a new aluminum-silicon alloy and a new article of manufacture, consisting essentially of an aluminum-silicon composite containing aluminum as its principal element, an alkaline earth metal or an alkali metal, especially magnesium, in sufficient quantity to be an effective reducing agent, and a substantial amount of an inert non-metallic filler such as zircon, alumina, zirconia and aluminum silicates, and a method of preparing said article wherein the alloying elements are heated to sufficient temperature to achieve good fluidity and the filler material is stirred therewith with sufficient stirring to distribute the filler throughout the molten metal. Other elements of the alloy and composite are copper, iron, titanium, magnesium and zinc.

DESCRIPTION OF THE PREFERRED EMBODIMENT

The preferred aluminum-silicon alloy of this invention comprises in percent by weight elements as follows:

| | |
|---|---|
| Silicon | 19–21 |
| Magnesium | 4–8 |
| Copper | 2–4 |
| Iron | 1 Maximum |
| Titanium | 0.3 Maximum |
| Manganese | 0.5 Maximum |
| Zinc | 0.5 Maximum |
| Aluminum | Balance |

The composite article of the invention comprises three principal ingredients, aluminum-silicon alloy, a metal reducing agent for reducing the surfaces of a non-metallic filler to a metal-like coating, and a non-metallic filler which is not subject to being reduced by aluminum metal and which can be effectively reduced by the metal reducing agent. Aluminum-silicon alloys or aluminum and silicon are the preferred principal metals or elements of the alloy composition. Magnesium is the preferred metal reducing agent with other alkaline earth or alkali metals, such as calcium, beryllium, sodium, potassium, rubidium and cesium, being suitable. The alkali metals have a relatively low solubility in aluminum, e.g., sodium is soluble only to about 0.25 weight percent at 775°C. These alkali metals therefore, although being suitable, have somewhat limited use. Preferred non-metallic fillers are zircon and alumina. Zirconia and aluminum silicates are also suitable.

When the composite material or article of this invention comprises magnesium and zircon, the magnesium is preferably in an amount by weight of about 2–10 percent of the liquid phase, with about 4.5 weight percent magnesium producing optimum results. When zircon is used as the non-metallic filler, the zircon may comprise from about 5–80 percent by weight of components, with about 10–40 percent being preferred and about 30–35 percent most preferred. The amount of magnesium or metal reducing agent required will vary somewhat with the amount of zircon or nonmetallic filler in the composite article.

When the non-metal filler of this invention is present in an amount of about 80 percent by weight and the amount of silicon in the aluminum-silicon alloy is about 19–21 percent by weight, the amount of silicon present in the composite is about 4 percent by weight.

When the non-metal filler is present in an amount of about 5 percent by weight and silicon is present in the aluminum-silicon alloy in an amount of about 19–21 percent by weight, the amount of silicon present in the composite is about 18 percent by weight.

The following table illustrates the amount of non-metal filler in the composite in relation to the amount of silicon in the composite.

| | Weight Percent | |
|---|---|---|
| Non-Metal Filler | 5 | 80 |
| Total Alloy | 95 | 20 |
| Total Composite | 100 | 100 |
| Si (19% of Total Alloy) | 18 | 3.8 |
| Si (21% of Total Alloy) | 20 | 4.2 |
| Si (25% of Total Alloy) | 23.75 | 5 |

The particle size of the filler may vary from about 60 mesh to about 400 mesh, U.S. Sieve Series, with a particle size of 100/140 mesh producing an excellent product. A filler or filler material of a distribution of particle sizes is preferable.

In the most preferred way of preparing or making the composite article of the present invention, aluminum and all metallic and silicon alloying elements except magnesium and zinc are heated to a temperature sufficient to achieve good fluidity, usually about 850°C, in a suitable furnace or crucible. The temperature necessary will vary with the particular alloying elements selected and the amount of inert filler to be added. The temperature will range between the melting point and the boiling point of the alloying elements. In general, it is desirable to use as low a temperature as will provide the desired degree of fluidity of the metallic phase.

After the desired temperature has been reached, the magnesium reducing metal and zinc, if zinc is included, are added to the molten metal or alloy. Stirring is commenced and the zircon filler is added. Although the filler may be added cold, it is preferably preheated to a temperature of about that of the melt. Stirring is continued until the filler is dispersed throughout the molten metal, usually about five minutes. The time of stirring will vary somewhat with the amount of filler added, and in general as short a stirring time as necessary to achieve adequate particle distribution is preferred. Optionally, the mixture is stirred until the filler is substantially equally distributed throughout the melt.

After mixing or stirring the molten mixture is cast in the form of ingots or other desired shapes.

When using a pre-prepared or standard aluminum-silicon-magnesium alloy as the metallic phase, the alloy is heated to temperature and the non-metallic filler is added thereafter. The molten mixture is stirred sufficiently to draw the filler into the molten phase.

In another way of carrying out the present invention, all of the ingredients of the composite article, except the metal reducing agent, preferably magnesium, are mixed together and heated to temperature. Magnesium is then added and the mixture stirred. Dross is skimmed from the molten mixture and the melt is then cast. This procedure reduces dross.

The aluminum composite or article of the instant invention may also be prepared by mixing all of the components of the article, namely aluminum, silicon and other elements, metal reducing agent, and non-metallic filler, together, then heating to desired temperature and stirring. The dross is skimmed from the melt and the molten mixture is poured into a mold and cast into a suitable shape. This procedure is preferably followed under an argon purge. Such a purge eliminates some dross from forming.

Hardness of the aluminum-silicon composite is increased by subjecting the composite to a three-stage heat treatment as follows:

a. conducting a solution heat treatment at 800°–1000°F for about 4 to 24 hours followed by a quench;
b. conducting a precipitation heat treatment at 200°–300°F for about 12 to 36 hours; and
c. conducting a second precipitation heat treatment at 300°–400°F for about 4 to 12 hours.

In order to facilitate understanding of the invention, the following examples are illustrative thereof; however, it is understood that these examples do not limit the scope of the invention in any fashion.

GENERAL PROCEDURE

The apparatus consisted of an electric heating element inside a firebrick housing, a foundry crucible, a motor-driven stirrer and a carbon rod baffle. Aluminum-silicon alloy and non-metallic filler, such as zircon or alumina were mixed in the crucible, heated to temperature and stirred. The charge was then poured into a crucible. After cooling, the casting was measured for hardness on a Rockwell tester using the E or B scale as appropriate. Hardness reading were recorded with standard deviation. The casting was then given a precipitation heat treatment at 250°F for 24 hours with an air quench. On some castings, a second precipitation heat treatment was conducted at 350°F for 8 hours. Hardness was measured on the Rockwell Tester after each heat treatment. Solution heat treatments were also conducted on some samples at 1,000°F for 16 hours. Hardness was also measured after these treatments.

Particle size distribution of the alumina and zircon fillers were as follows, unless otherwise specified:

| Particle Size | Weight Percent Alumina | Zircon |
|---|---|---|
| 40/70 | 0.0 | 2.2 |
| 70/100 | 4.5 | 19.1 |
| 100/140 | 52.5 | 53.4 |
| 140/200 | 19.7 | 7.2 |
| 200/325 | 18.2 | 7.3 |
| 325/400 | 2.9 | 7.3 |
| 400/ — | 2.2 | 3.5 |

EXAMPLE 1

A sample of a commercially available alloy suitable for use in automobile engines hereinafter referred to as Alloy A was prepared by mixing 766 parts of Al, 170 parts of Si, 45 parts of Cu, 10 parts of Fe, 5 parts of Mg, 2 parts of Ti, 1 part of Mn, and 1 part of Zn. This mixture was heated under argon at 850°C and cast. The cast plug was placed in a 600°C oven for 8 hours and completely melted. It was cooled, sawed into pieces, remelted at 550°C and cast. The alloy had a Rockwell E hardness of 87.8 ± 3.0 (standard deviation). The specimen was given a precipitation heat treatment at 250°F for 24 hours with an air quench, after which it had a Rcokwell B hardness of 76.6 ± 4.8 (standard deviation).

EXAMPLE 2

The following were mixed, heated to 850°C for 1 hour and stirred for a brief period: 695 parts of Al, 190 parts of Si, 40 parts of Cu, 9 parts of Fe, 62 parts of Mg, 2 parts of Ti, 1 part of Mn, and 1 part of Zn. The alloy (Alloy 1) was cast and cooled. The Rockwell E hardness on the resulting casting was 78.5 ± 1.4 (standard deviation). The specimen was precipitation heat treated at 250°F for 24 hours with an air quench. The Rockwell B hardness on the specimen was then 59.3 ± 3.3 (standard deviation). The specimen was then given another precipitation heat treatment at 350°F for 8 hours. This resulted in a Rockwell B hardness of 68.3 ± 2.0 (standard deviation).

EXAMPLE 3

720 parts of Alloy 1 were recovered from Example 2. To this alloy was added 388 parts of ground zircon and the mixture was heated to 850°C under an argon purge, then stirred for 5 minutes. The Rockwell B value was 46.5 ± 9.3 (standard deviation) on the resulting specimen. After 24 hours at 250°F, the hardness increased to 61.2 ± 8.3 (standard deviation), and an additional 8 hours at 350°F resulted in a value of 64.7 ± 9.7 (standard deviation).

EXAMPLE 4

Beginning with this example, the ceramic crucibles were replaced with 4 inch steel pipes which were sealed at one end and given four coats of Carborundum Fiberfrax Coating Cement, Type QF-180. The stirrer was similarly coated. The charge consisted of 464 parts of Al, 127 parts of Si, 27 parts of Cu, 6 parts of Fe, 41 parts of Mg, 1.3 parts of Ti, 0.6 parts of Mn and 0.6 parts of Zn. This Alloy 1 mixture was heated to 850°C as usual. 233 parts of ground zircon were stirred in the alloy mixture over a 2-minute period, then the stirrer speed was increased and stirring continued for an additional 2 minutes. Large pieces of undissolved silicon were clearly visible in the casting; therefore, it was discarded.

Thirty parts of Cu, 521 parts of Al, 143 parts of Si, 6.8 parts of Fe, 1.5 parts of Ti, 0.75 parts of Mn, and 0.75 parts of Zn were mixed together and heated to 850°C in the usual way. After 30 minutes, the stirrer was submerged and 46.5 parts of Mg were added. After 5 minutes of stirring, the stirrer was removed, and then resubmerged after 10 minutes. After 5 minutes had passed, 350 parts of ground zircon were stirred in the mixture. This took about 2 minutes; then the stirrer speed increased and stirring continued until a total of 5 minutes had elapsed. The Rockwell E hardness value was 76.1 ± 1.1 (standard deviation). After 24 hours at 250°F the hardness value had increased to 90.8 ± 0.9 (standard deviation). The specimen was then heated to 350°F for 8 hours with the result that the hardness increased to 67.5 ± 1.7 (standard deviation) on the Rockwell B scale.

A solution heat treatment at 1000°F for 16 hours was then given and the specimen water quenched. The Rockwell E value was 84.9 ± 7.4 (standard deviation). Repeating the two-step precipitation heat treatment from above resulted in a Rockwell B value of 63.2 ± 12.1 (standard deviation) after the first step and after the second step, a top side value of 64.2 ± 16.9, and a bottom (protected) side value of 81.4 ± 5.2 were obtained.

EXAMPLE 5

A specimen from Example 3 was given the same solution heat treatment and quench as in Example 4. The resulting Rockwell E hardness was 80.0 ± 3.1 (standard deviation), and the usual two-step precipitation heat treatment resulted in Rockwell B values of 66.2 ± 1.2 (standard deviation), and 72.5 ± 9.9 (standard deviation).

The results obtained in Examples 2, 3, 4 and 5 are summarized in Table I, hereinafter. This Alloy 1, consisted of, by weight, 69.5% Al, 19.0% Si, 4.0% Cu, 0.9% Fe, 6,2% Mg, 0.2% Ti, 0.1% Mn and 0.1% Zn. The alloy incorporated 35% zircon filler with no apparent difficulty. Significant improvement of alloy is obtained with a two-step precipitation heat treatment. A solution heat treatment at 925°F for one hour followed by a simple precipitation heat treatment was less effective in hardening the alloy samples. The addition of the filler did not significantly decrease the effectiveness of the two-step precipitation heat treatment. A solution heat treatment at 1,000°F for 16 hours followed by a two-step precipitation heat treatment showed promise of significant improvement. Some high temperature oxidation damage was indicated, but this can be easily prevented by the use of an inert atmosphere during the solution heat treatment. The protected side hardness value of 81.4 ± 5.2 compares very favorably with the hardness of 76.6 ± 4.8 obtained for Alloy A.

TABLE I

| System | Rockwell E Hardness As Cast | Precipitation Heat Treatment Temp., °F | Time, hr. | Rockwell B Hardness | Temp., °F | Time, hr. | Rockwell B Hardness | Solution Heat Treatment Temp., °F | Time, hr. | Rockwell E Hardness |
|---|---|---|---|---|---|---|---|---|---|---|
| Alloy A | 87.8 ± 3.0 | 250 | 24 | 76.6 ± 4.8 | | | | | | |
| Alloy 1 | 78.5 ± 1.4 | 250 | 24 | 59.3 ± 3.3 | 350 | 8 | 68.3 ± 2.0 | — | — | — |
| Alloy 1 + 35% Zircon | 46.5 ± 9.3[a] | 250 | 24 | 61.2 ± 8.3 | 350 | 8 | 64.7 ± 9.7 | — | — | — |
| [b] | — | 250 | 24 | 61.2 ± 1.2 | 350 | 8 | 72.5 ± 9.9[c] | 1000 | 16 | 80.0 ± 3.1 |
| Alloy 1 + 35% Zircon | 76.1 ± 1.1 | 250 | 24 | 90.8 ± 0.9 | 350 | 8 | 67.5 ± 1.7 | — | — | — |
| [b] | — | 250 | 72 | 63.2 ± 12.1 | 350 | 8 | 64.2 ± 16.9[c] | 1000 | 16 | 84.9 ± 7.4 |

TABLE I-continued

| System | Rockwell E Hardness As Cast | Precipitation Heat Treatment Temp., °F | Time, hr. | Rockwell B Hardness | Temp., °F | Time, hr. | Rockwell B Hardness | Solution Heat Treatment Temp., °F | Time, hr. | Rockwell E Hardness |
|---|---|---|---|---|---|---|---|---|---|---|
| | | | | | | | 81.4 ± 5.2[d] | | | |

[a]Rockwell B Hardness
[b]Same specimen
[c]Top side value
[d]Bottom side value

EXAMPLE 6

An alloy was prepared to simulate one which would be obtained by using primary reduction alloy as the silicon source, 353 parts of a 60% Al, 35% Si, 3% Fe, 2% Ti alloy were mixed with 231 parts of Al, 26 parts of Cu, 0.5 part of Zn, and 0.5 part of Mn and heated to 850°C as usual. After 1 hour at temperature, 39 parts of Mg were added and after 5 minutes stirred for 2 minutes. After an additional 18 minutes, 350 parts of ground zircon were stirred in the alloy with a gradual increase in stirring speed until a total of 5 minutes has elapsed. The product was much too viscous to pour.

EXAMPLE 7

One-hundred thirty parts of powdered silicon, 39 parts of Mg, 26 parts of Cu, 65 parts of Zn and 390 parts of Al were mixed and heated to 850°C as usual, and following the same procedure as in Example 6, 350 parts of ground zircon were stirred in with the same results as in Example 6. Repeating this example using a different crucible and a thermocouple check gave the same results.

EXAMPLE 8

Example 7 repeated using lump Si in place of powdered Si. After successful casting and the above series of heat treatments, the Rockwell B values, with standard deviation were in order: 96.3 ± 4.4; 94.0 ± 8.0; 94.0 ± 6.0; 99.6 ± 4.0; and finally 100.4 ± 3.9.

EXAMPLE 9

Exactly the same procedure as in Example 8 was followed except that alumina was used in place of zircon. The material could be poured but was too viscous to fill the mold well. As cast, it had a Rockwell B value with standard deviation of 70.3 ± 1.9, and after 5 days of natural aging it increased to 81.6 ± 5.8.

EXAMPLE 10

The procedures of Example 9 were repeated except 30% $Al_2O_3$ was used in place of 35%. An excellent casting was obtained.

EXAMPLE 11

The following were mixed and heated to 850°C in the usual way: 465 parts of Al, 124 parts of Si (powdered), 13 parts of Cu, 5.6 parts of Fe, 40 parts of Mg, 1.0 part of Ti, 0.7 part of Mn, 0.7 part of Zn. After 1 hour at temperature, 350 parts of ground zircon were stirred in as above with the same results as in Example 7. The example was repeated except that lamp Si was used in place of powdered Si and the Mg was not added until just before the ground zircon. In this case, a fluid system resulted. A specimen was cast and cooled. The specimen had a Rockwell B hardness of 82.8 ± 12.2 (standard deviation). Regular solution and two-stage precipitation heat treatments were given except a nitrogen purge was used during the solution treatment and 72 hours elapsed between solution and precipitation heat treatments. The resulting Rockwell B values with standard deviation were 84.0 ± 8.8; 91.0 ± 12.6; 85.0 ± 11.3; and 90.4 ± 5.2, respectively.

EXAMPLE 12

Normal heating and mixing procedures were used with 330 parts of Al, 110 parts of Si, 22 parts of Cu, 55 parts of Zn, 33 parts of Mg and 450 parts of ground zircon. The mixture was too viscous to pour. Repeating the example with 360 parts of Al, 120 parts of Si, 24 parts of Cu, 36 parts of Mg, 60 parts of Zn, and 400 parts of ground zircon results similar to those obtained in Example 9 castability. As cast, the Rockwell B value was 89.4 ± 4.1, after solution treating 88.9 ± 6.7, and precipitation heat treatments gave Rockwell E values of 95.3 ± 3.2, 212 and 98.3 ± 2.1.

EXAMPLE 13

Four-hundred twenty parts of aluminum, 140 parts of Si and 28 parts of Cu were mixed and heated to 850°C under an argon purge, the stirrer was submerged and 70 parts of Zn and 42 parts of Mg were added. The tensile specimen mold was heated to 850°C and the other two molds to 670°C. Using usual stirring procedure, 300 parts of zircon were stirred in, then a $Cl_2$ purge given and the ladle used to fill the molds. The molds did not fill well and there were large quantities of unincorporated powder, excessive deterioration of the stirrer was also noted.

The above example was repeated using a new stirrer and a new steel tensile specimen mold. Flame was noted during the addition of the zircon (a newly composited and ground sample was being used). The tensile specimen was broken in the constricted region. The Rockwell B hardness value was 92.5 ± 4.1. After 16 hours at 1000°F under purge followed by a water quench, the Rockwell B hardness value was 84.0 ± 4.0. The usual two-stage precipitation heat treatments gave 85.7 ± 4.8, and 87.0 ± 3.2, respectively. The above example was again repeated except that no tensile specimen was poured, the liquid was poured rather than ladled, and the hardness mold was coated with one coat of Fiberfrax cement and maintained at 500°C. Flaming was again noted. After casting and cooling, the Rockwell E value was 89.0 ± 2.2. Repeating the above except a 1-hour soak at temperature before the stirrer was submerged, again resulted in flaming. As cast, solution heat treated, and two-step precipitation treatments gave, in order, Rockwell B values of 60.8 ± 11.3; 55.9 ± 9.9; 63.9 ± 8.9; and 78.6 ± 2.4.

Changing procedure, 420 parts of Al, 140 parts of Si, and 28 parts of Cu were mixed and heated to temperature and maintained for 1 hour with normal stirring every 10 minutes. The stirrer was submerged, the temperature allowed to recover, and 42 parts of Mg and 70 parts of Zn were added. In this case, 300 parts of ground zircon were added and the above procedure followed from this point. There was no indication of any flame. The same series of treatments as above were given with these respective Rockwell B hardness values: 47.3 ± 12.8; 69.6 ± 7.0, 69.9 ± 9.8 and 71.3 ± 7.8.

EXAMPLE 14

A new alloy system was prepared by mixing 518 parts of Al and 70 parts of Si and heating to 850°C and maintaining for 1 hour. Then 42 parts of Mg were added along with 70 parts of Zn. The usual procedure was followed from that point including a $Cl_2$ purge. Neither test specimen was of any use.

The above was again repeated except all metallic ingredients were mixed at the beginning and no $Cl_2$ purge was given. The as cast, solution and two-stage precipitation (Rockwell E hardness) values were, in order: 63.4 ± 2.8; 77.6 ± 6.4; 79.8 ± 3.7; and 84.7 ± 4.7.

The alloy compositions of Examples 7–14 are summarized in Table II hereinafter.

TABLE II

| | Elements and Filler in Percent by Weight | | | | | | | | |
|---|---|---|---|---|---|---|---|---|---|
| | Al | Mg | Si | Cu | Fe | Ti | Mn | Zn | Zircon | Alumina |
| Exs. 7 | | | | | | | | | | |
| and 8 | 39.0 | 3.9 | 13.0 | 2.6 | | | | 6.5 | 35.0 | |
| Ex. 9 | 39.0 | 3.9 | 13.0 | 2.6 | | | | 6.5 | | 35.0 |
| Ex. 10 | 42.0 | 4.2 | 14.0 | 2.8 | | | | 7.0 | | 30.0 |
| Ex. 11 | 46.5 | 4.0 | 12.4 | 1.3 | 0.5 | 0.1 | 0.1 | 0.1 | 35.0 | |
| Ex. 12 | 33.0 | 3.3 | 11.0 | 2.2 | | | | 5.5 | 45.0 | |
| Ex. 13 | 42.0 | 4.2 | 14.0 | 2.8 | | | | 7.0 | 30.00 | |
| Ex. 14 | 51.8 | 4.2 | 7.0 | | | | | 7.0 | | 30.00 |

When the same ratio of components, with the exception of the magnesium content, as was the case with Alloy A, was used as a basic alloy for a filler experiment, considerable experimental difficulties were encountered and a very poor product was obtained.

The basic reason for the significantly harder than usual nature of Alloy A is the presence of crystalline silicon in a metal matrix. That alloy contains 17% silicon and the eutectic mixture for aluminum and silicon is 11.7. Therefore, about onethird of the total silicon would crystallize out on cooling and be dispersed in the metal matrix. In the case of Alloy A there is no other component that would use up any significant amount of the excess silicon. When one adds sufficient amounts of magnesium to allow incorporation of the filler one has a different situation. Magnesium reacts with silicon to form the intermetallic $Mg_2Si$ and thus significantly reduces the amount of Si which is free to crystallize out. Thus, one significantly reduces the hardness of the alloy. A new alloy was prepared that was designed to have the same amount of silicon free to crystallize out after allowance was made for the silicon removed as the magnesiumsilicon intermetallic. This new alloy as cast was 85% as hard as Alloy A which may be due to the presence of the intermetallic. After the 250°F precipitation heat treatment to obtain the beneficial effects of the copper content, the hardness increased by 51% to 107 Brinell number which was 75% of Alloy A value at that point. After the 350°F precipitation heat treatment which was beneficial the Brinell number was 121, which was an increase of 12% over the previous value and 86% of the final Alloy A value.

Such an alloy produces an excellent metallic phase for a filled aluminum product.

There are very significant results contained in the foregoing examples. The Rockwell B hardness of 100.4 ± 3.9 obtained in Example 8 is unique among casting alloys whose value is considerably less in the majority of cases and reaching higher values only in such special cases as the Alloy A engine alloy. Even wrought aluminum alloys do not generally reach this value. Such a product is comparable with brass in hardness.

EXAMPLE 15

Following the procedure of Example 14 except that the alloy system was held at 850°C for 2 hours, a series of samples were made using two types of zircon in Alloy 2, the percentages by weight being 42.0 Al; 14.0 Si; 2.8 Cu; 7.0 Zn; 4.2 Mg; and 30.0 zircon. The samples were then tested for Brinell hardness after casting, solution heat treatment and first and second stage precipitation heat treatment. The results of these tests are set forth in Table III as follows:

TABLE III

| | Brinell Hardness | | | |
|---|---|---|---|---|
| | | | Precipitation Heat Treatment | |
| | As Cast | Solution Heat Treatment | First Stage | Second Stage |
| Zircon | 198 | 162 | 169 | 172 |
| Zircon (Flame during addition) | 108 | 101 | 114 | 146 |
| DuPont Zircon | 81 | 125 | 125 | 141 |

EXAMPLE 16

Tensile strengths of Alloy 2 with 35% zircon were determined and the results are illustrated in Table IV as follows:

TABLE IV

| Composite | Yield Strength kpsi | Ultimate Strength kpsi | Percent Elongation |
|---|---|---|---|
| Alloy 2 + 35% Zircon | 3.6 | 13.5 | 5.3 |

EXAMPLE 17

Hardness and tensile strength of various alloys were compared as a function of the level of zircon loading at various percentages from 0 to 30 for alloys as follows:

| Alloy | Al | Mg | Si | Zn | Cu |
|---|---|---|---|---|---|
| | Percent by Weight of Elements in Metallic Phase | | | | |
| 2 | 60.0 | 6.0 | 20.0 | 10.0 | 4.0 |

TABLE V

| | Rockwell E Hardness Percent Zircon | | | | | |
|---|---|---|---|---|---|---|
| | 0 | 10 | 15 | 20 | 25 | 30 |
| Alloy 2 - As Cast | 89.6 | 85.0 | 86.2 | 75.6 | 92.1 | 96.4 |
| After Solution Heat Treatment | 83.9 | 59.4 | 71.5 | 70.7 | 80.3 | 85.8 |
| After 250° Precipitation H.T. | 97.8 | 88.3 | 87.7 | 83.8 | 93.6 | 91.5 |
| After 350° H.T. | 59.7* | 69.5 | 81.9 | 83.3 | 59.7* | 87.9 |

*Rockwell B Hardness

TABLE VI

| | Tensile Strength (kpsi) Percent Zircon | | | | | |
|---|---|---|---|---|---|---|
| | 0 | 10 | 15 | 20 | 25 | 30 |
| Alloy 2 | 12.0 | | 9.8 | 7.4 | 11.0 | 8.1 |

Similar tests using bismuth, a more effective metal at lowering surface tension, showed that bismuth was not capable of reducing the filler surfce and was completely ineffective in producing a satisfactory composite article. Other tests using quartz as a filler indicated that the filler must be sufficiently stable so that it will not be reduced by the aluminum, but must be reduced by the metal reducing agent, namely magnesium.

The foregoing tests and other tests, showed that to obtain successful results at a 25–30% by weight filler level, there must be effective stirring. The stirrer must also be in good condition and run at effective speeds. When contact times are on the order of 5 minutes, a minimum of about 4% by weight of magnesium is required to produce a satisfactory product. At a higher percentage of magnesium loadings, the contact time may be shorter. Stirring or contact time and amount of filler go together. The degree of reduction of the filler is determined by the kinetics of the reduction which in turn is dependent on the concentration-time ratio.

Once the powdered filler was incorporated it showed little tendency to separate by any mechanism other than Stokes law settling of the particles. Settling is quite slow because of the smallness of the grains, the high viscosity of the metallic phase and the extereme similarity of the particle and melt density, especially with alumina as the filler. Uniquely, no separation of particles was observed when the filled products were remelted and recast.

An increase in temperature of the mixture of about 20°C was observed when the filler was added. This increase is due in part to stirring and chemical reaction.

Tin, which is an effective metal for reducing surface tension of aluminum, would not provide the reducing action necessary for a successful product.

Hardness is a physical property that will have an effect on the useability of the filled product as a replacement for other aluminum-silicon casting alloys. The normal hardness range for such casting alloys is from a Brinell number of about 50 to a Brinell number of about 120.

It may be seen that while there is a significant increase in hardness between the basic aluminum-silicon-magnesium alloy and the same alloy with filler, i.e., a factor of about 2 with 25% alumina and about 3 with 25% zircon, the best values obtained are still in the lower portion of the desired range.

Some control of the physical properties of the aluminumsilicon composite of this invention may be obtained by selection of an appropriate filler material. If a tough cut or drill resistant composite at some sacrifice of density is desired, zircon may be selected as a filler. If such properties are of less importance and low density is desired, alumina would probably be selected as the filler.

The volume of the filler in the metallic phase is the crucial factor in determining the amount of filler that can be accepted by the metallic phase and still retain metallic like properties. The weight percent of filler that may be used is different for each filler and is dependent upon the filler density.

Intricate castings can be satisfactorily produced using the molten filled aluminum-silicon composite of this invention with little or no loss of desired physical properties as compared with a comparable unfilled aluminum-silicon alloy casting.

The foregoing disclosure and description of the invention is illustrative and explanatory thereof and various changes may be made within the scope of the appended claims without departing from the spirit of the invention.

What is claimed is:

1. A hard generally uniform metallic composite consisting essentially of a dispersion of particles between about 60 mesh and about 400 mesh in size of a hard filler selected from the group consisting of zircon, alumina, zirconia and aluminum silicates, the dispersion being in an aluminum-silicon alloy containing by weight 19 to 21% silicon, 4 to 8% magnesium and 2 to 4% copper, the balance of the alloy being essentially aluminum, and about 5 to about 80% by weight of the composite being the dispersed particles.

2. The composite of claim 1 in which the filler is zircon.

3. The composite of claim 1 in which the proportion of filler in the composite is between about 10 and about 40% by weight.

4. The composite of claim 1 in which the alloy is essentially, in percent by weight,

| | |
|---|---|
| Silicon | 19–21 |
| Magnesium | 4–8 |
| Copper | 2–4 |
| Iron | 1 Maximum |
| Titanium | 0.3 Maximum |
| Manganese | 0.5 Maximum |
| Zinc | 0.5 Maximum |
| Aluminum | Balance |

and the proportion of filler in the composite is between about 10 and about 40% by weight.

* * * * *